US006424243B1

(12) United States Patent
Forster

(10) Patent No.: US 6,424,243 B1
(45) Date of Patent: Jul. 23, 2002

(54) MAGNETIC LATCHING CONTACTOR

(75) Inventor: Richard D. Forster, Decatur, AL (US)

(73) Assignee: Prestolite Electric Incorporated, Ann Arbor, MI (US)

( * ) Notice: Subject to any disclaimer, the term of this patent is extended or adjusted under 35 U.S.C. 154(b) by 0 days.

(21) Appl. No.: 09/847,243

(22) Filed: May 2, 2001

Related U.S. Application Data

(63) Continuation of application No. 09/507,349, filed on Feb. 18, 2000, now Pat. No. 6,236,293, which is a continuation-in-part of application No. 09/422,922, filed on Oct. 21, 1999, now abandoned.

(60) Provisional application No. 60/121,509, filed on Feb. 23, 1999.

(51) Int. Cl.[7] ..... H01H 67/02

(52) U.S. Cl. ..... 335/132; 335/229

(58) Field of Search ..... 355/220–229, 355/230, 132, 202

(56) References Cited

U.S. PATENT DOCUMENTS 3,821,671 A * 6/1974 Grunert et al. ..... 335/132
4,025,883 A * 5/1977 Slade et al. ..... 335/178
5,374,912 A * 12/1994 Houck, III ..... 335/132

* cited by examiner

*Primary Examiner*—Lincoln Donovan

(74) *Attorney, Agent, or Firm*—Renner, Kenner, Greive, Bobak, Taylor & Weber

(57) ABSTRACT

The present invention provides a magnetic latching contactor for high current switching applications. A stationary assembly is provided which comprises a first passive biasing member and an active biasing member. A moveable assembly is slidably coupled to the stationary assembly for movement between a first stable position and a second stable position. A second passive biasing member is also provided. The first passive biasing member applies a first passive biasing force to the moveable assembly biasing the moveable assembly toward the first stable position. The second passive biasing member applies a second passive biasing force to the moveable assembly biasing the moveable assembly toward the second stable position. The active biasing member provides an active biasing force to the moveable assembly alternatively biasing the moveable assembly to the first stable position and the second stable position. In the absence of the active biasing force, the first passive biasing force is sufficient to maintain the moveable assembly in the first stable position, and the second passive biasing force is sufficient to maintain the moveable assembly in the second stable position. A momentary active biasing force is applied to the moveable assembly to move the moveable assembly between the first stable position and the second stable position. A contact assembly is provided which is coupled to the stationary assembly and the moveable assembly such that an electrical closed circuit is established in the first stable position and an electrical open circuit is established in the second stable position.

9 Claims, 15 Drawing Sheets

MAGNETIC LATCHING CONTACTOR

CROSS REFERENCE TO RELATED APPLICATIONS

This application is a continuation of and claims priority from U.S. application Ser. No. 09/507,349, filed Feb. 18, 2000, now U.S. Pat. No. 6,236,293, which is a continuation-in-part application of Ser. No. 09/422,922, filed Oct. 21, 1999, Mar. 21, 2002 now abandoned; with all applications claiming priority from U.S. provisional application Ser. No. 60/121,509, filed Feb. 23, 1999, and all applications being incorporated herein in their entirety by reference.

STATEMENT REGARDING FEDERALLY SPONSORED RESEARCH OR DEVELOPMENT (NOT APPLICABLE)

BACKGROUND OF THE INVENTION

The present invention relates generally to electrical contactors. More specifically, the present invention relates to magnetic latching contactors that use electrical current pulses to change switching positions.

Electrical contactors and relays are commonly used for switching relatively large amounts of electrical current using relatively low current switching signals. An electrical contactor typically has electrical switching contacts for closing and opening an electrical circuit connected to the contactor. An electromechanical device is typically utilized to move the electrical switching contacts into and out of physical contact, thereby closing and opening the electrical circuit, respectively. The operation of the electromechanical device, in turn, is typically controlled by a relatively low current switching signal.

Many contactors have one passive stable switching position and one unstable active switching position. The stable switching position is passively maintained in the absence of externally provided active energy. For instance, a simple spring is often used to bias the electrical contacts into a first switching position, which will then be passively maintained. When a change in switching position is desired, an electrical switching signal is provided to the contactor, which in turn induces an active switching force on the electrical contacts. The active switching force moves the contacts into a second switching position, which is maintained until the electrical switching signal is removed from the contactor. A significant drawback to contactors with only one stable switching position is that energy must continually be supplied to the contactor to maintain the unstable switching position. This inefficient use of energy results in higher operational costs and also introduces heating problems into the contactor use and design.

To address these problems and others, contactors have been designed which provide multiple stable switching positions. Various arrangements and types of switching elements, electrical coils, springs, permanent magnets and mechanical latching mechanisms have been proposed to provide contactors with multiple stable switching positions.

While contactors with multiple stable switching positions have performed satisfactorily, those working in this art have recognized that important design improvements are needed. These include contactor reliability, particularly in high current switching applications where safety is of primary concern. One drawback of present contactors using mechanical latching mechanisms is that the latching mechanisms tend to wear out over time. To avoid the unreliability of mechanical latching mechanisms, some contactor designs utilize permanent magnets for latching. However, the permanent magnets are often placed in positions exposing them to mechanical stress and shock. The permanent magnets themselves then become potential failure points. Manufacturability is another important concern since it is closely related to product cost and quality. Typical contactor designs providing two stable switching positions involve a high number of piece-parts in manufacturably undesirable configurations. Also contactors have been designed to operate over a particular electrical current range, and these designs are not necessarily readily extendible to a contactor designed to operate over a different current range.

Hence, a longstanding need has existed for an improved electrical contactor that has multiple stable switching positions and that is cost effective, reliable, manufacturable and extendible to a variety of electrical current ranges.

SUMMARY OF THE INVENTION

Accordingly, it is an object of the present invention to provide an electrical contactor with multiple stable switching positions.

It is also an object of the present invention to provide an electrical contactor that has multiple stable switching positions that is reliable that exhibits a relatively high degree of manufacturability; and that is extendible to a wide variety of switched current ranges.

The foregoing objects are met in whole or in part by the disclosed magnetic latching electrical contractor. More specifically, the improved contactor of the present invention comprises a stationary assembly, which has a solenoid assembly.

The solenoid assembly includes a stationary core assembly and a coil assembly. The stationary core assembly has a stationary core and a base member. The stationary core comprises a first passive permanent magnet biasing member and is attached to the base member. The coil assembly includes a conductive coil wound on a bobbin so as to define an axial cavity. The coil assembly is attached to the base member with a solenoid assembly cover such that a substantial portion of the stationary core of the solenoid assembly is positioned in the axial cavity of the coil assembly.

The improved contactor also includes a moveable assembly that is slidably attached to the stationary assembly for movement between a first stable switching position and a second stable switching position. The moveable assembly comprises a movable core assembly that has a moveable core substantially positioned in the interior space of the coil assembly. A longitudinal shaft extends axially from the movable core. A second passive biasing member is also provided and applies a second passive biasing force to the moveable assembly thereby biasing the moveable assembly toward the second stable switching position.

The solenoid assembly serves as an active biasing member that provides an active biasing force to the moveable assembly. The solenoid assembly alternatively biases the moveable assembly toward the first stable switching position and the second stable switching position. In the absence of an active biasing force, the first passive biasing force is sufficient to maintain the moveable assembly in the first stable switching position, and the second passive biasing force is sufficient to maintain the moveable assembly in the second stable position. The active biasing member is used to apply a momentary active biasing force to the moveable assembly to move the moveable assembly between the first stable switching position and the second stable switching position. The stationary assembly and the moveable assembly include contact members which are arranged such that an electrical closed circuit is established in the first stable switching position and an electrical open circuit is established in the second stable switching position.

DETAILED DESCRIPTION OF THE PREFERRED EMBODIMENTS OF THE INVENTION

In the following descriptions, spatially orienting terms are used, such as "upper," "lower," "left," "right," "vertical," "horizontal," and the like. It is to be understood that these terms are used for convenience of description of the preferred embodiments with reference to the drawings. These terms do not necessarily describe the absolute location in space, such as left, right, upward, downward, etc., that any part must assume.

Figure 1:
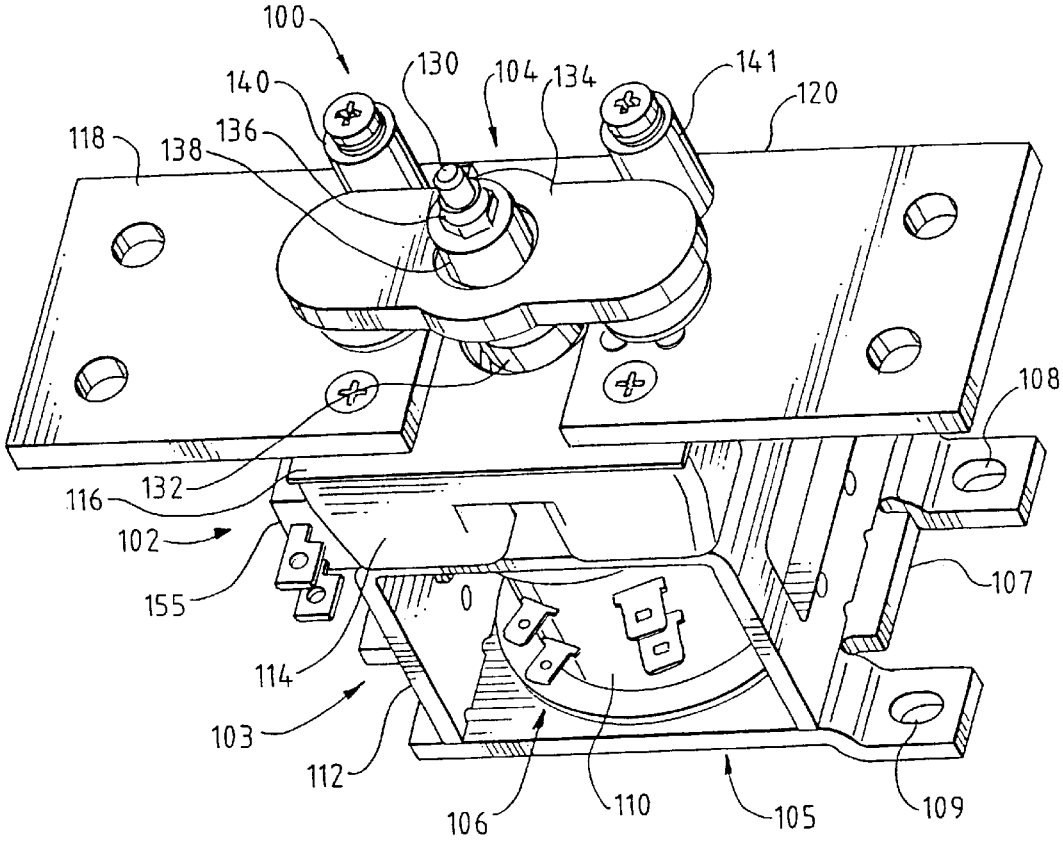
FIG. 1 contains a perspective view of one preferred embodiment of a magnetic latching contactor of the present invention.

Referring now to FIG. 1, a magnetic latching contactor, which is an embodiment of the present invention, is indicated generally at 100. The contactor 100 includes a stationary assembly 102 and a movable assembly 104. The stationary assembly 102 has a solenoid assembly 103, which in turn comprises a stationary core assembly 105 and a coil assembly 106.

The stationary core assembly 105 includes a base member 107 with mounting holes 108, 109 that may be used to attach the contactor 100 to a panel or other supporting member. The coil assembly 106 is attached to the base member 107 with a solenoid assembly cover 112.

The stationary assembly 102 further comprises a movable core restraining member 114, which is attached to the solenoid assembly cover 112. The stationary assembly 102 also comprises an insulating member 116 and stationary contact plates 118 and 120, which are attached to the movable core restraining member 114.

Figure 2:
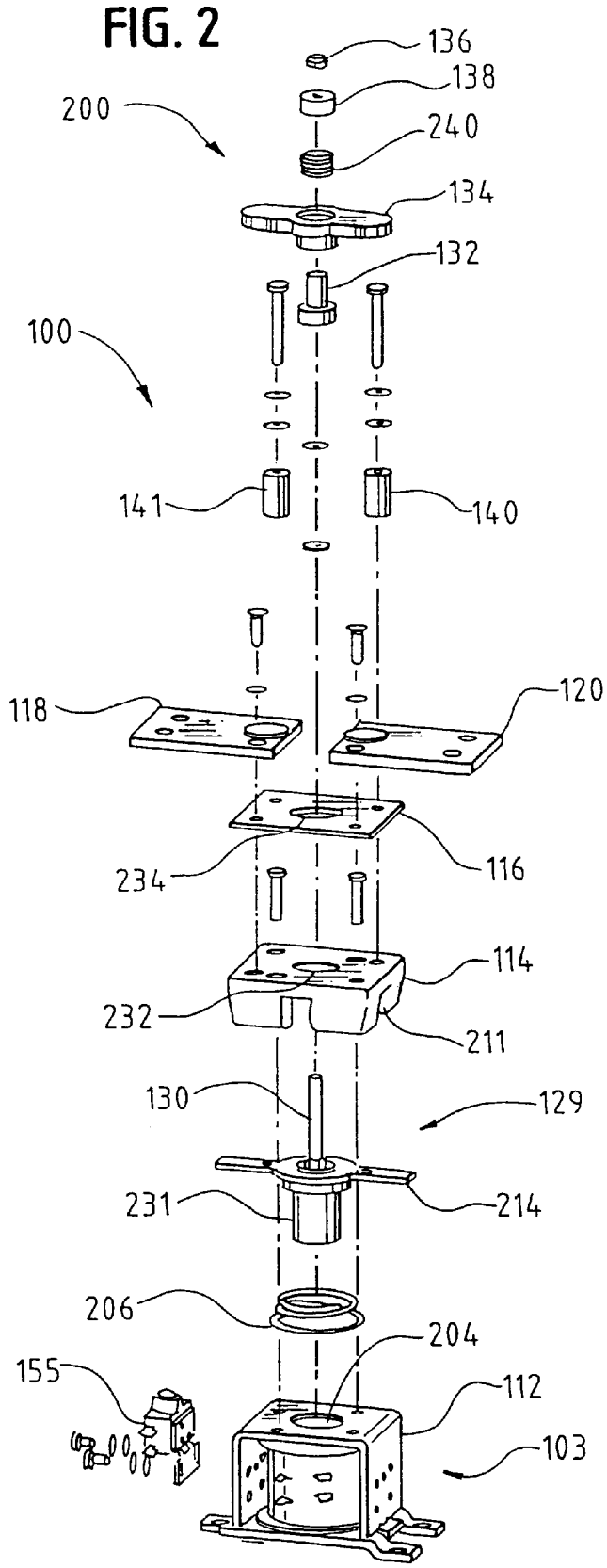
FIG. 2 is an assembly view of the contactor of FIG. 1.

The movable assembly 104 is axially disposed relative to the stationary assembly 102 and comprises a moveable core assembly, indicated at 129 in FIG. 2. The moveable core assembly 129 comprises a longitudinal shaft 130 (or tie rod) which extends axially through the top of the stationary assembly 102. The movable assembly 104 also comprises a lower bridge bushing 132 and switch contact bridge 134, which are attached to the longitudinal shaft 130 of the moveable core assembly 129. A nut 136, upper bridge bushing 138 and a bridge spring, indicated at 240 in FIG. 2, are utilized to compliantly attach the switch contact bridge 134 to the longitudinal shaft 130. The compliant attachment of the preferably rigid switch contact bridge 134 to the longitudinal shaft 130 serves to absorb mechanical shock and reduce switch bounce.

The stationary assembly 102 comprises bridge rotation restriction members 140, 141, which are mounted to the movable core restraining member 114 and serve to restrict rotary motion of the switch contact bridge 134 about the axis of the longitudinal shaft 130. A control switch 155 is mounted to the side of the solenoid assembly cover 112, which may be utilized by a user of the contactor 100 for controlling contactor operation.

FIG. 2 illustrates the manufacturable assembly 200 of the magnetic latching contactor 100. The movable core 231 of the moveable core assembly 129 is inserted into the inner axial cavity 204 of the solenoid assembly 103. A return spring 206, serving as a passive biasing member, is disposed about the moveable core 231 and between the moveable core assembly 129 and the solenoid assembly 103 to passively bias the moveable core assembly 129 to a first (or upper) stable switching position. The moveable core restraining member 114 is fixedly attached to the solenoid assembly 103. The moveable core assembly 129 comprises an operator plate 214, which is fixedly attached to the moveable core 231. The moveable core restraining member 114 includes slots 211 (one of which is shown in FIG. 2) in which the radially outer ends of the operator plate 214 of the moveable core assembly 129 reside. The interaction between the slots 211 and operator plate 214 restrict the movement of the moveable core assembly 129 to a predetermined longitudinal range (preferably between a first stable switching position and a second stable switching position). The operator plate serves as a longitudinal travel limiting member and as a means to manually operate the contactor 100.

The insulating member 116 and two stationary contact plates 118 and 120 are fixedly attached to the moveable core restraining member 114. The stationary contact plates 118 and 120 serve as terminals for the electrical line being switched by the contactor 100. The longitudinal shaft 130 of the moveable core assembly 129 extends upward through an axial hole 232 in the moveable core restraining member 114 and an axial hole 234 in the insulating member 116. The lower bridge bushing 132 and switch contact bridge 134 are disposed over the longitudinal shaft 130 of the moveable core assembly 129 such that the switch contact bridge 134 is vertically disposed above the switch contact plates 118 and 120. The switch contact bridge 134 is biased downward against the lower bridge bushing 132 by a spring 240 and upper bridge bushing 138 which are axially disposed over the longitudinal shaft 130. A nut 136 is threaded onto the upper end of the longitudinal shaft 130 to restrict longitudinally upward movement of the upper bridge bushing 138 relative to the longitudinal shaft 130. The bridge rotation restriction members 140 and 141 are mounted to the moveable core restraining member 114 to maintain the rotational alignment of the switch contact bridge 134 over the stationary contact plates 118 and 120.

Figure 3:
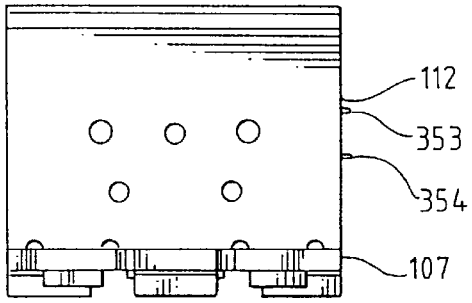
FIG. 3 is an end view of the solenoid assembly for the contractor of FIG. 1.
Figure 4:
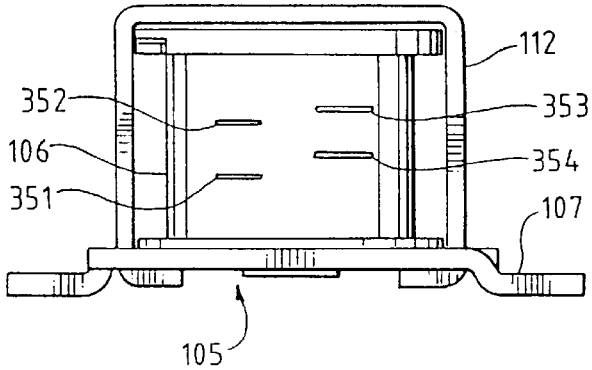
FIG. 4 is a side view of the assembly of FIG. 3.
Figure 5:
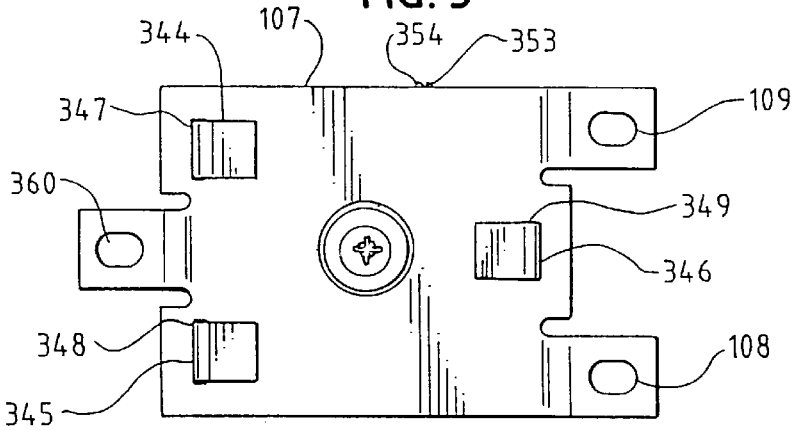
FIG. 5 is a bottom view of the assembly of FIG. 3.

Side and front and bottom views of the solenoid assembly 103 are shown in FIGS. 3–5 respectively. The coil assembly 106 is disposed axially over the stationary core, indicated at 402 in FIG. 6, of the stationary core assembly 105. The coil assembly 106 rests on the base member 107 of the stationary core assembly 105 and is held in place by the solenoid assembly cover 112. The solenoid assembly cover 112 is mounted to the base member 107 with folded tabs 344, 345 and 346 inserted through tab slots 347, 348 and 349, respectively, in the base member 107. The coil assembly 106 includes winding terminals 351, 352, 353 and 354 for supplying electric current to the electrical winding, indicated at 602 in FIG. 10, of the coil assembly 106. The coil assembly 106 serves as an active biasing member for applying longitudinal forces to the moveable assembly 104. Also shown in FIG. 3 are the three mounting holes 108, 109 and 360 in the base member 107.

Figure 6:
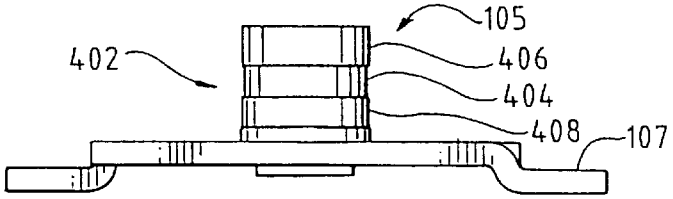
FIG. 6 is a side view of the stationary core assembly for the contactor of FIG. 1.
Figure 7:
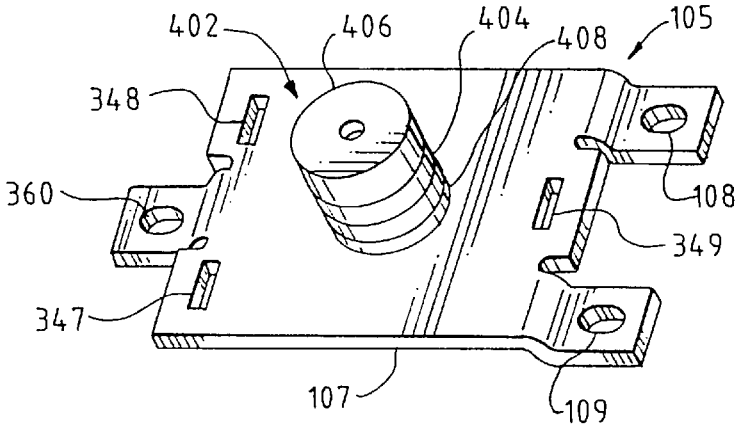
FIG. 7 is a perspective top view of the assembly of FIG. 6.
Figure 8:
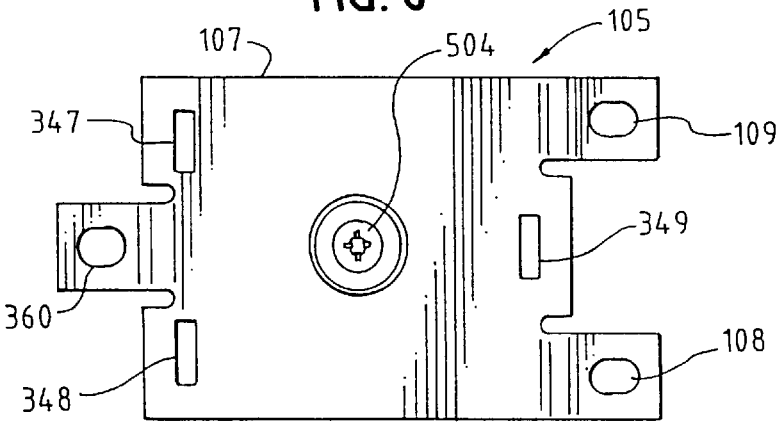
FIG. 8 is a bottom view of the assembly of FIG. 6.

FIGS. 6–8 contain front, perspective and bottom views, respectively, of the stationary core assembly 105. The stationary core 402 is axially mounted (preferably ring-staked) to the base member 107. A permanent magnet 404 is axially disposed between an upper stationary core member 406 and a lower stationary core member 408.

Figure 9:
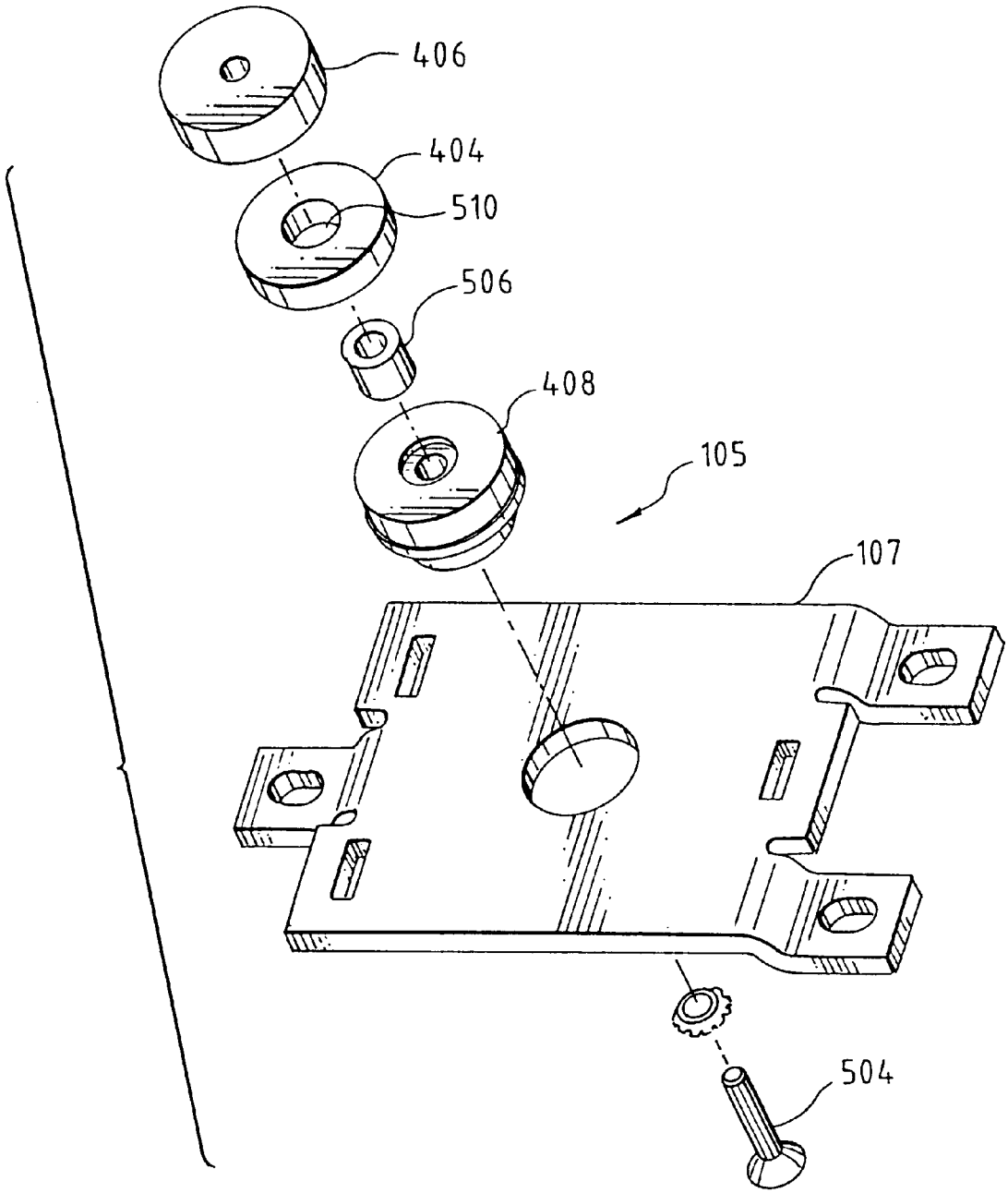
FIG. 9 is an assembly view of a stationary core assembly for the contactor of FIG. 1.

An assembly diagram for the stationary core assembly 105 is illustrated in FIG. 9. The lower stationary core member 408 is fixedly attached (preferably ring-staked) to the base member 107. The permanent magnet 404 and upper stationary core member 406 are fixedly axially attached to the lower stationary core member 408 with a fastener 504. The fastener 504 is preferably a screw screwed into a threaded upper stationary core member 406. Additionally, a magnetic protecting spacer 506 is axially disposed about the fastener 504 between the upper stationary core member 406 and the lower stationary core member 408. The magnetic protecting spacer 506 is axially disposed within the inner axial space 510 in the permanent magnet 404. By contacting the lower face of the upper stationary core member 406 and the upper face of the lower stationary core member 408 through the inner axial space 510 of the permanent magnet 404, the magnetic protecting spacer 506 protects the permanent magnet 404 from longitudinal mechanical shock.

Figure 10:
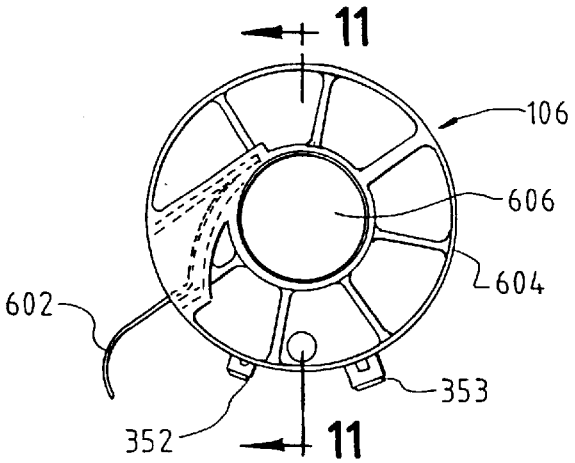
FIG. 10 is a top view of the coil assembly of the contractor of the FIG. 1.
Figure 11:
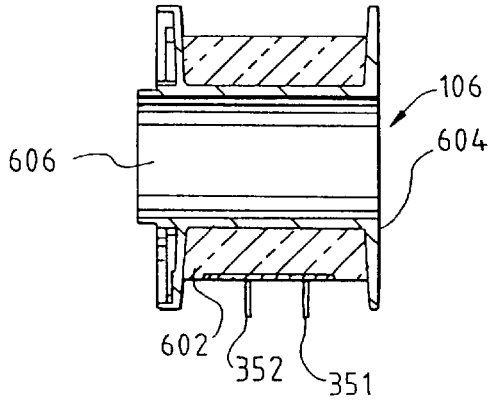
FIG. 11 is a cross-sectional view taken along the line A—A in FIG. 10.
Figure 12:
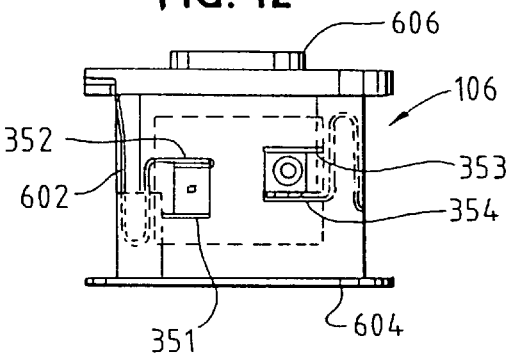
FIG. 12 is a side view of the assembly of FIG. 10.

Referring back to FIG. 4, the coil assembly 106 is placed axially over the stationary core 402 of the stationary core assembly 105. FIGS. 10–12 show top, side cutaway (taken along line A—A of FIG. 10), and side views, respectively, of the coil assembly 106. An electrical winding 602 is wound about a bobbin 604. The ends of the electrical winding 602 are terminated in winding terminals 351–354, which are disposed about the radially outward surface of the coil assembly 106. The inner diameter of the bobbin 604 defines an inner axial cavity 606. When the coil assembly 106 is mounted to the stationary core assembly 105, the stationary core 402 of the stationary core assembly 105 resides substantially in the inner axial cavity 606 of the coil assembly 106.

Figure 13:
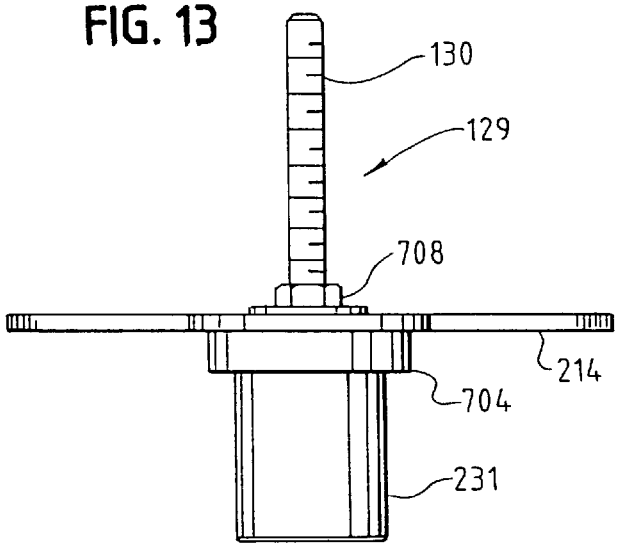
FIG. 13 is a side view of the moveable core assembly for the contactor of FIG. 1.
Figure 14:
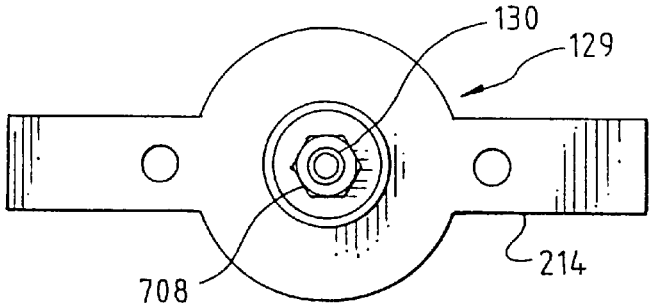
FIG. 14 is a top view of the assembly of FIG. 13.

Referring back to FIG. 2, the movable core 231 of the moveable core assembly 129 is inserted into the inner axial cavity 204 of the solenoid assembly 103. FIGS. 13 and 14 show side and top views, respectively, of the moveable core assembly 129. The moveable core assembly 129 comprises a movable core 231 fixedly attached (preferably ring-staked) to an operator plate 214 with a moveable core washer 704 disposed therebetween. The longitudinal shaft 130 is attached (preferably threaded) to the moveable core 231. A hexnut 708 is threaded on the longitudinal shaft 130 to rotationally, and thus longitudinally, stabilize the longitudinal shaft 130.

Figure 15:
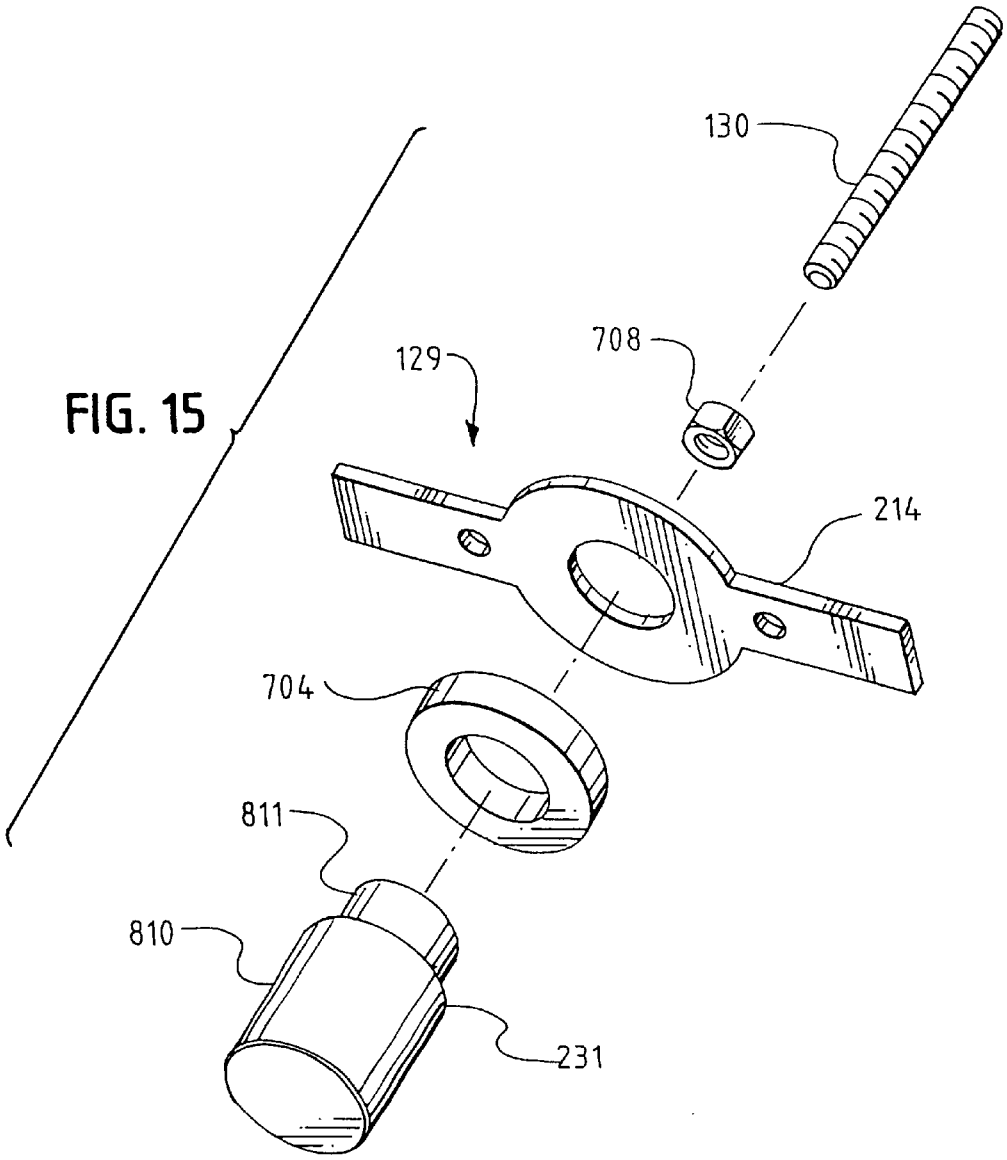
FIG. 15 is an assembly view of the assembly of FIG. 13.

An assembly diagram for the moveable core assembly 129 is shown in FIG. 15. The movable core 231 has a wide section 810 and a narrow section 811. A moveable core washer 704 is axially disposed about the narrow section 811. The operator plate 214 is similarly disposed about the narrow section 811, which is then preferably ring-staked to the operator plate 214. The top end of the movable core 231 is preferably tapped to receive the threaded longitudinal shaft 130, which is axially threaded into the tapped movable core 231 such that the desired longitudinal length of the longitudinal shaft 130 extends from the moveable core 231. The hexnut 708 is threaded onto the threaded longitudinal shaft 130 and tightened to the movable core 231 to rotationally, and thus longitudinally, stabilize the longitudinal shaft 130.

In operation, the moveable assembly 104 passively assumes one of the first stable switching position and the second stable switching position. When the moveable assembly 104 is in the first stable switching position, the first passive biasing force applied to the moveable assembly 104 by the first passive biasing member (e.g., the permanent magnet 404) is greater than the second passive biasing force applied to the moveable assembly 104 by the second passive biasing member (e.g., the return spring 206). Thus, in the absence of an additional biasing force, the moveable assembly 104 remains in the first stable switching position.

Conversely, when the moveable assembly 104 is in the second stable switching position, the second passive biasing force applied to the moveable assembly 104 by the second passive biasing member (e.g., the return spring 206) is greater than the first passive biasing force applied to the moveable assembly 104 by the first passive biasing member (e.g., the permanent magnet 404). Thus, in the absence of an additional biasing force, the moveable assembly remains in the second stable switching position. When a user or switching control system desires the contactor 100 to change switching states, a current is momentarily forced through the electrical winding 602 of the coil assembly 106 thereby creating a momentary active biasing force which acts on the moveable assembly 104. The electrical current is of a sufficient magnitude, duration and direction to cause the moveable assembly 104 to change switching positions to the desired switching position. The moveable assembly 104 then remains in the new switching position when the active biasing force is discontinued. The moveable assembly is passively maintained in the new switching position until another active biasing force is applied which moves the moveable assembly 104 to a different switching position.

Figure 16:
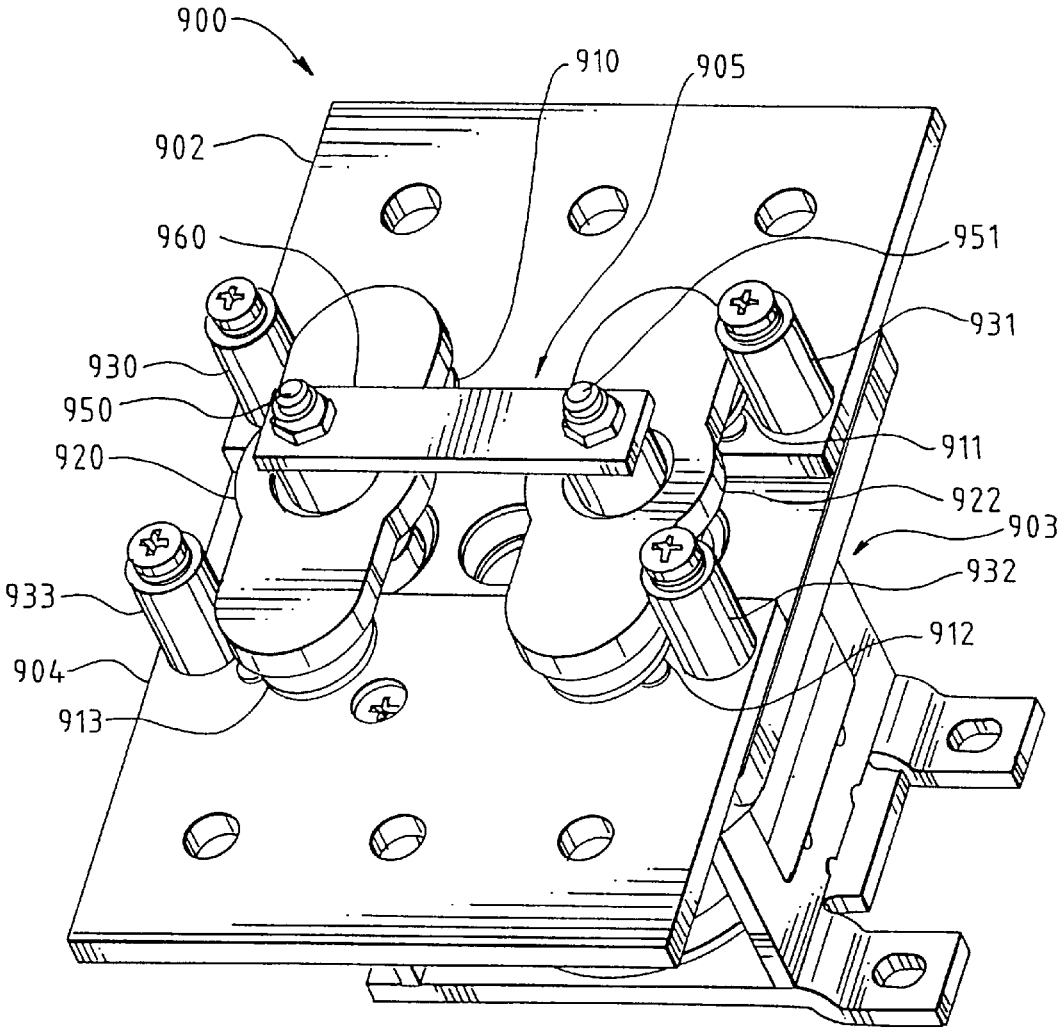
FIG. 16 is a perspective view of another preferred embodiment of the magnetic latching contactor of the present invention.

An alternative contactor 900 according to an alternative embodiment of the present invention for switching greater magnitudes of electrical current is illustrated in FIG. 16. The contactor 900 is similar in many ways to the contactor 100 illustrated in FIGS. 1–15. Therefore the subsequent description will primarily focus on the structural differences between the contactor 100 and the alternative embodiment contactor 900.

The alternative contactor 900 comprises two relatively wide stationary contact plates 902 and 904. The wide stationary contact plates 902 and 904 each include two stationary switch contacts 910, 911 and 912, 913, respectively. The moveable assembly 905 comprises two switch contact bridges 920 and 922. The moveable assembly 905 moves between two stable switching positions. In the first (or upper) stable switching position, the switch contact bridges 920 and 922 are out of contact with the stationary switch contacts 910, 911 and 912, 913. In the second (or lower) stable switching position, the first switch contact bridge 920 contacts the first pair of stationary switch contacts 910 and 913, and the second switch contact bridge 922 contacts the second pair of stationary switch contacts 911 and 912, thereby establishing an electrical connection between the wide stationary plates 902 and 904. The stationary assembly 903 comprises four bridge rotation restriction members 930, 931, 932 and 933 to restrict rotational movement of the switch contact bridges 920 and 922 about their respective longitudinal shafts 950 and 951. A cross-bridge member 960 is attached to both longitudinal shafts 950 and 951 to add stability to the movable core assembly 905.

Figure 17:
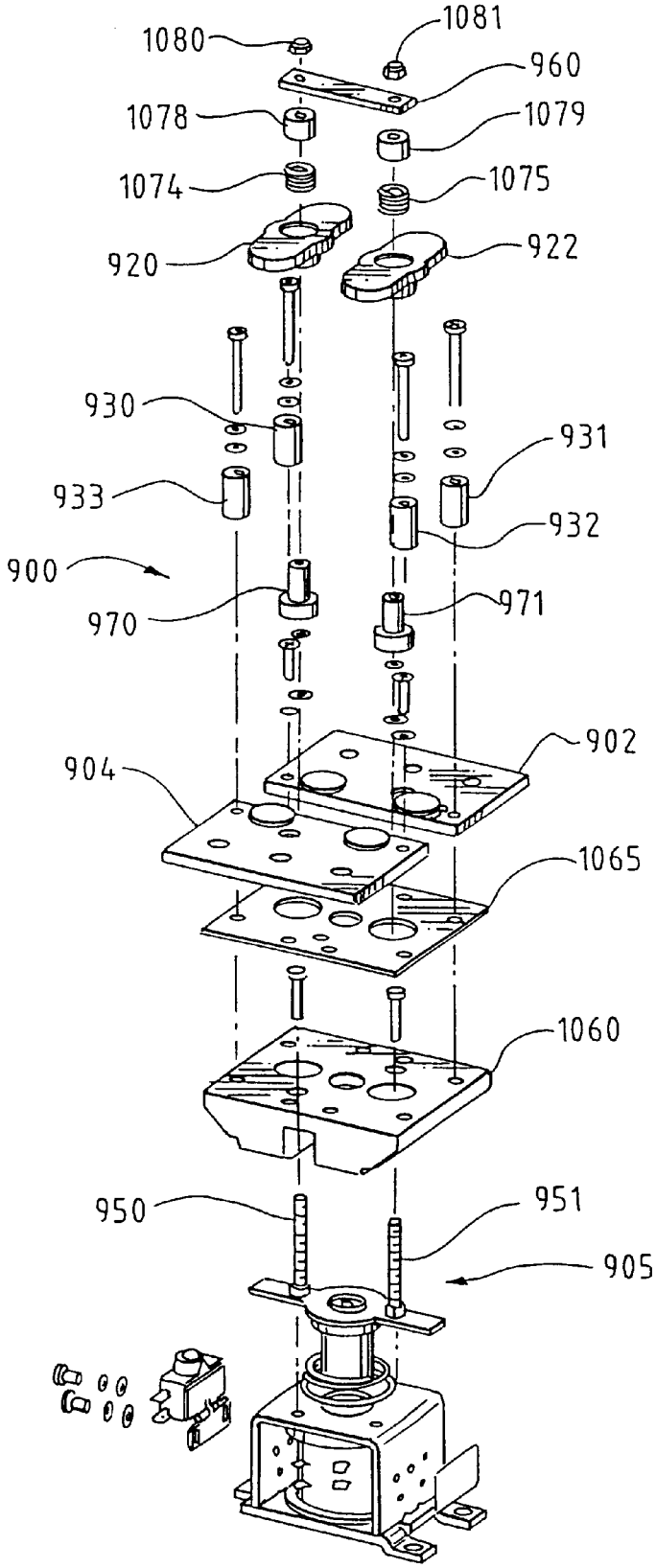
FIG. 17 is an assembly view of the contactor of FIG. 16.

An assembly diagram for the alternative contactor 900 is shown in FIG. 17. The assembly of the alternative contactor 900 is similar to the assembly of the more preferred embodiment contactor 100. As will be discussed in more detail later, the moveable core assembly 905 comprises two longitudinal shafts 950 and 951. The moveable core restraining member 1060 and insulating member 1065 each comprises two longitudinal holes for the longitudinal shafts 950 and 951 to pass through. The wide stationary contact plates 902 and 904 are fixedly attached to the moveable core restraining member 1060. Two lower bridge bushings 970 and 971 and switch contact bridges 920 and 922 are inserted over their respective longitudinal shafts 950 and 951. Similarly two bridge springs 1074 and 1075 and upper bridge bushings 1078 and 1079 are axially disposed over their respective longitudinal shafts 950 and 951. The cross-bridge member 960 is inserted over the longitudinal shafts 950 and 951, and held down by two nuts 1080 and 1081 threaded onto their respective longitudinal shafts 950 and 951. The four bridge rotation restriction members 930, 931, 932 and 933 are fixedly attached to the moveable core restraining member 1060.

Figure 18:
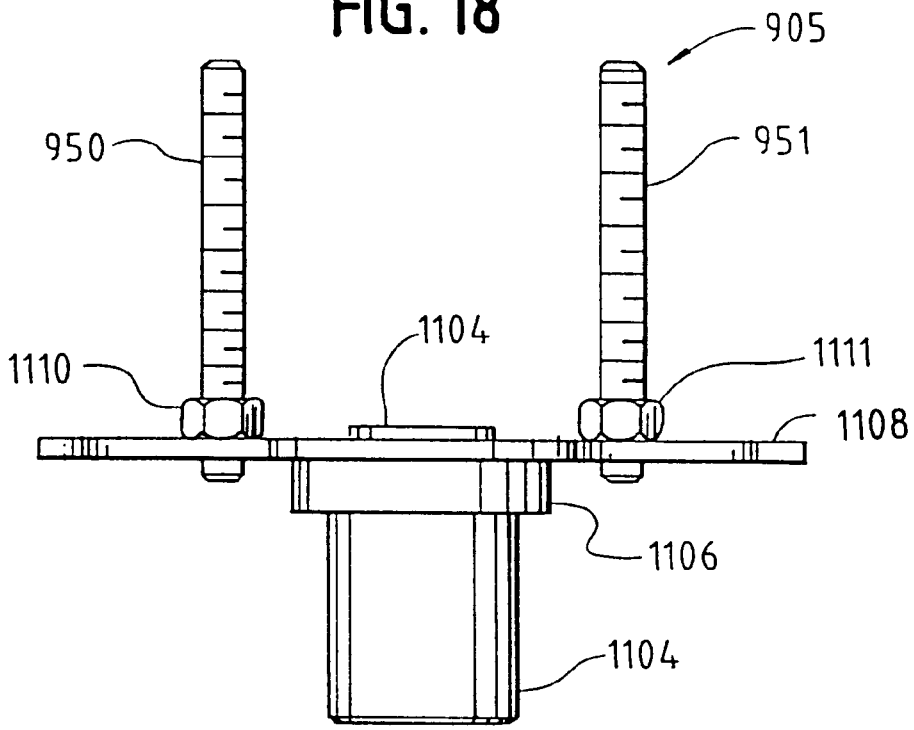
FIG. 18 is a side view of the moveable core assembly for the contactor of FIG. 16.
Figure 19:
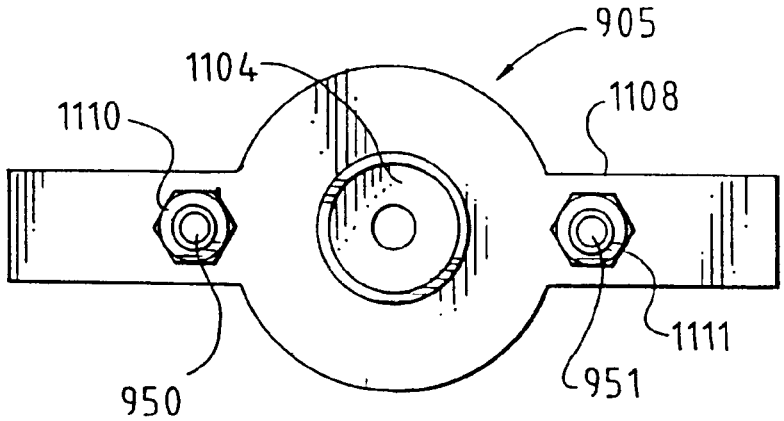
FIG. 19 is a top view of the assembly of FIG. 18.
Figure 20:
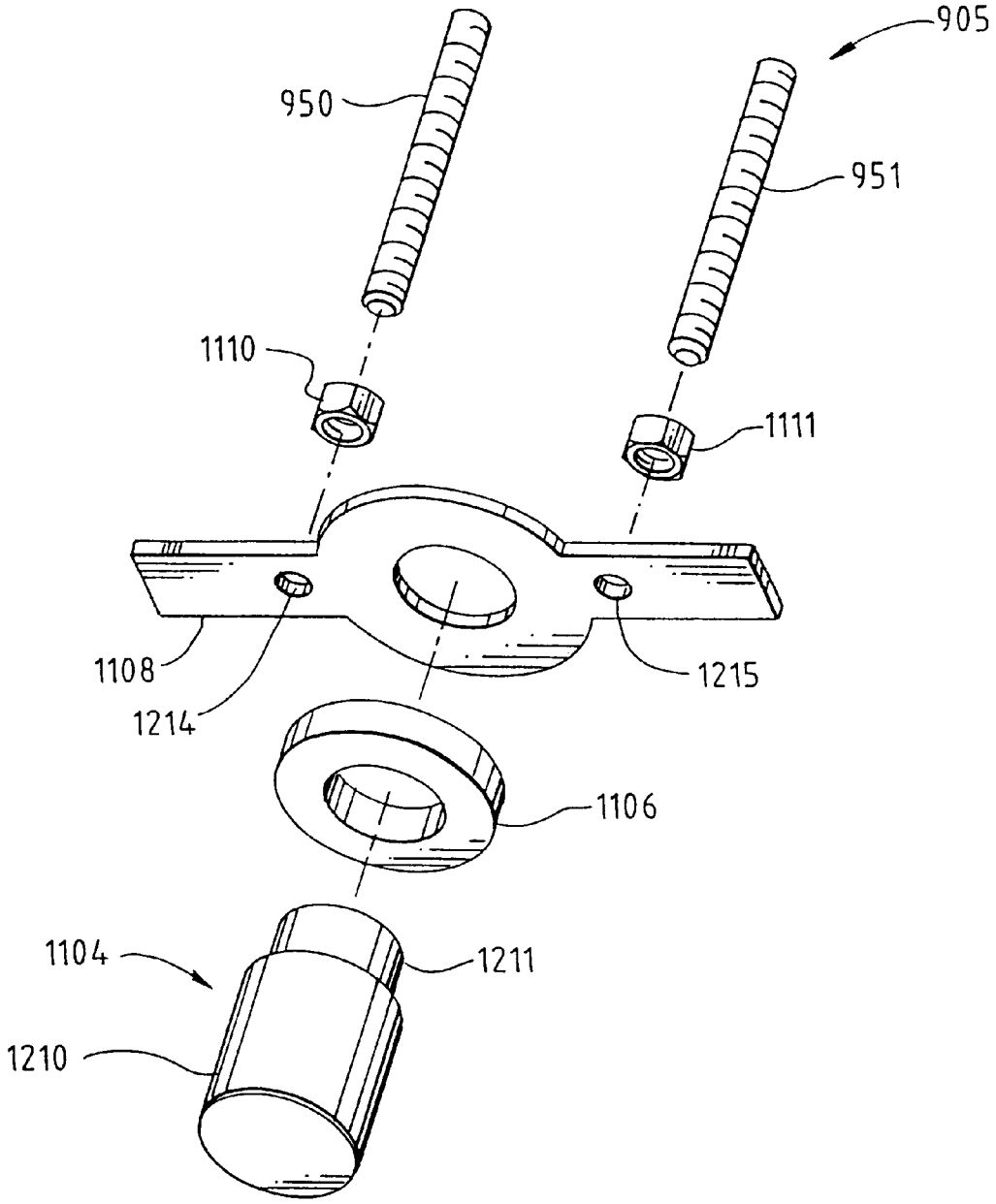
FIG. 20 is an assembly view of the assembly of FIG. 18.

Side and top views of the moveable core assembly 905 for the alternative contactor 900 are illustrated in FIGS. 18 and 19, respectively. The moveable core assembly 905 comprises a moveable core 1104 fixedly attached (preferably ring-staked) to the operator plate 1108 with a moveable core washer 1106 disposed therebetween. The two longitudinal shafts 950 and 951 are longitudinally attached (preferably threaded) to the operator plate 1108. Two hexnuts 1110 and 1111 are threaded on the longitudinal shafts 950 and 951, respectively, to rotationally, and thus longitudinally, stabilize the longitudinal shafts 950 and 951.

An assembly diagram for the moveable core assembly 905 for the alternative contactor 900 is shown in FIG. 12. The movable core 1104 has a wide section 1210 and a narrow section 1211. The moveable core washer 1106 is axially disposed about the narrow section 1211. The operator plate 1108 is similarly disposed about the narrow section 1211, which is then preferably ring-staked to the operator plate 1108. The operator plate 1108 comprises two tapped holes 1214 and 1215 to receive the threaded longitudinal shafts 950 and 951, which are axially threaded into the tapped holes 1214 and 1215 in the operator plate 1108 such that the desired longitudinal lengths of the longitudinal shafts 950 and 951 extend from the operator plate 1108. The hexnuts 1110 and 1111 are threaded onto the threaded longitudinal shafts 950 and 951 and tightened to the operator plate 1108 to rotationally, and thus longitudinally, stabilize the longitudinal shafts 950 and 951.

Figure 21:
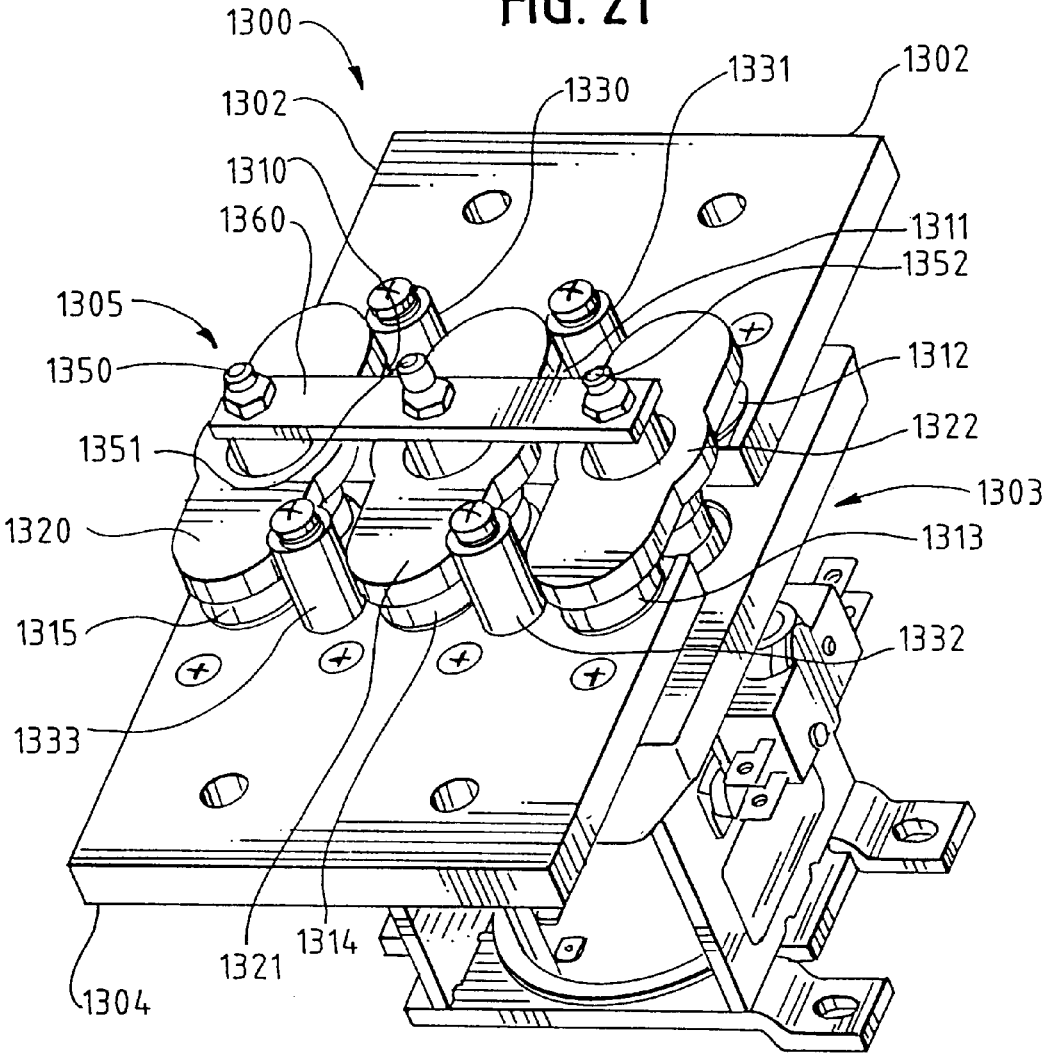
FIG. 21 is a perspective view of a third preferred embodiment of the magnetic latching contactor of the present invention.

Another alternative contactor 1300 according to a second alternative embodiment of the present invention for switching greater magnitudes of electrical current is illustrated in FIG. 21. The contactor 1300 is similar in many ways to the more preferred embodiment contactor 100 illustrated in FIGS. 1–15 and to the previously discussed alternative embodiment illustrated in FIGS. 16–20. Similar to the above description of FIGS. 16–20, the subsequent description will primarily focus on the structural differences between the more preferred embodiment contactor 100 and the second alternative embodiment contactor 1300.

The second alternative contactor 1300 comprises two relatively wide stationary contact plates 1302 and 1304. The wide stationary contact plates 1302 and 1304 each include three stationary switch contacts 1310, 1311, 1312 and 1313, 1314, 1315 respectively. The moveable assembly 1305 comprises three switch contact bridges 1320, 1321, and 1322. The moveable assembly 1305 moves between two stable switching positions. In the first (or upper) stable switching position, the switch contact bridges 1320, 1321, and 1322 are out of contact with the stationary switch contacts 1310, 1311, 1312 and 1313, 1314, 1315. In the second (or lower) stable switching position, the first switch contact bridge 1320 contacts the first pair of stationary switch contacts 1310 and 1315, the second switch contact bridge 1321 contacts the second pair of stationary switch contacts 1311 and 1314, and the third switch contact bridge 1322 contacts the third pair of stationary switch contacts 1312 and 1313, thereby establishing an electrical connection between the wide stationary plates 1302 and 1304. The stationary assembly 1303 comprises four bridge rotation restriction members 1330, 1331, 1332 and 1333 to restrict rotational movement of the switch contact bridges 1320, 1321, and 1322 about their respective longitudinal shafts 1350, 1351, and 1352. A cross-bridge member 1360 is attached to each of the longitudinal shafts 1350, 1351, and 1352 to add stability to the movable core assembly 1305.

Figure 22:
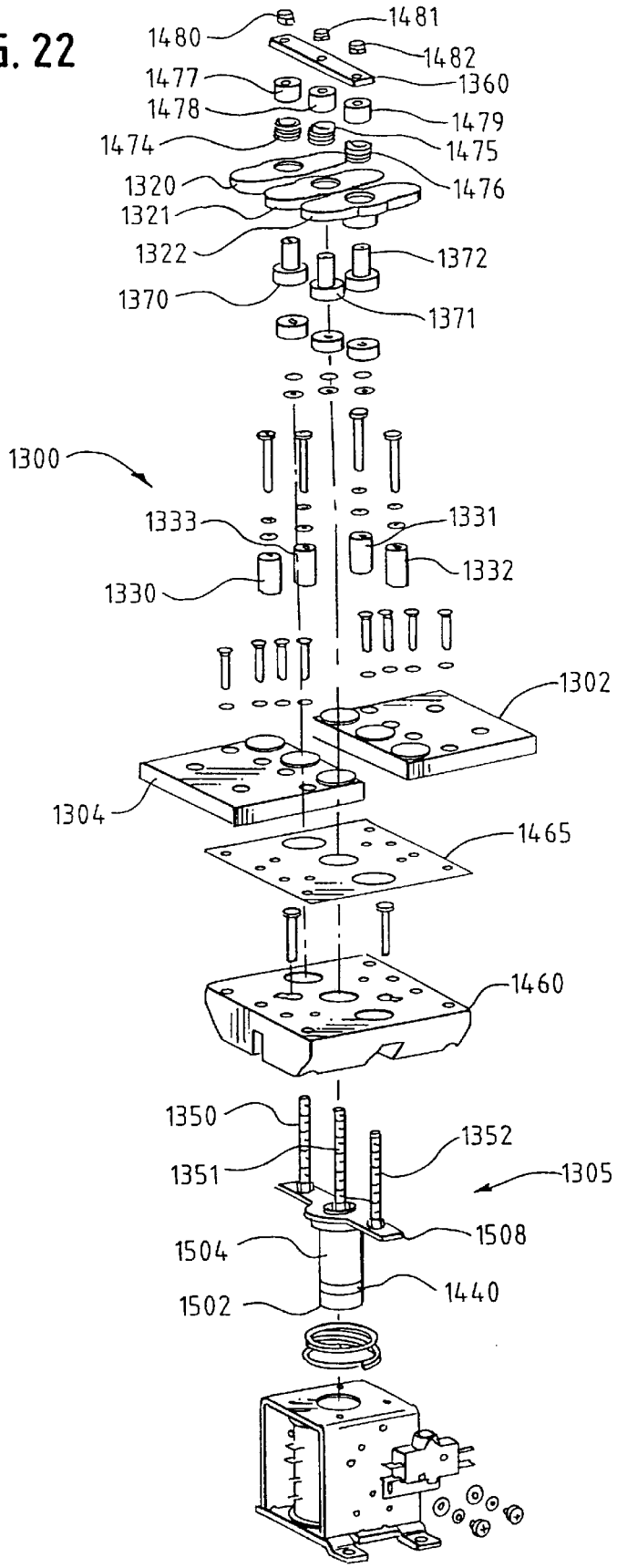
FIG. 22 is an assembly view of the contactor of FIG. 21.

An assembly diagram for the second alternative contactor 1300 is shown in FIG. 22. The assembly of the alternative contactor 1300 is similar to the assemblies of both the more preferred embodiment contactor shown in FIGS. 1–15, and of the first alternative contactor shown in FIGS. 16–20. As will be discussed in more detail later, the moveable core assembly 1305 comprises three longitudinal shafts 1350, 1351 and 1352. The moveable core restraining member 1460 and insulating member 1465 each comprises three longitudinal holes for the longitudinal shafts 1350, 1351 and 1352 to pass through. The wide stationary contact plates 1302 and 1304 are fixedly attached to the moveable core restraining member 1460. Three lower bridge bushings 1370, 1371 and 1372, and switch contact bridges 1320, 1321 and 1322 are inserted over their respective longitudinal shafts 1350, 1351 and 1352. Similarly three bridge springs 1474, 1475 and 1476, and upper bridge bushings 1477, 1478 and 1479 are axially disposed over their respective longitudinal shafts 1350, 1351 and 1352. The cross-bridge member 1360 is inserted over the longitudinal shafts 1350, 1351 and 1352, and held down by three nuts 1480, 1481 and 1482 threaded onto their respective longitudinal shafts 1350, 1351 and 1352. The four bridge rotation restriction members 1330, 1331, 1332 and 1333 are fixedly attached to the moveable core restraining member 1460.

Figure 23:
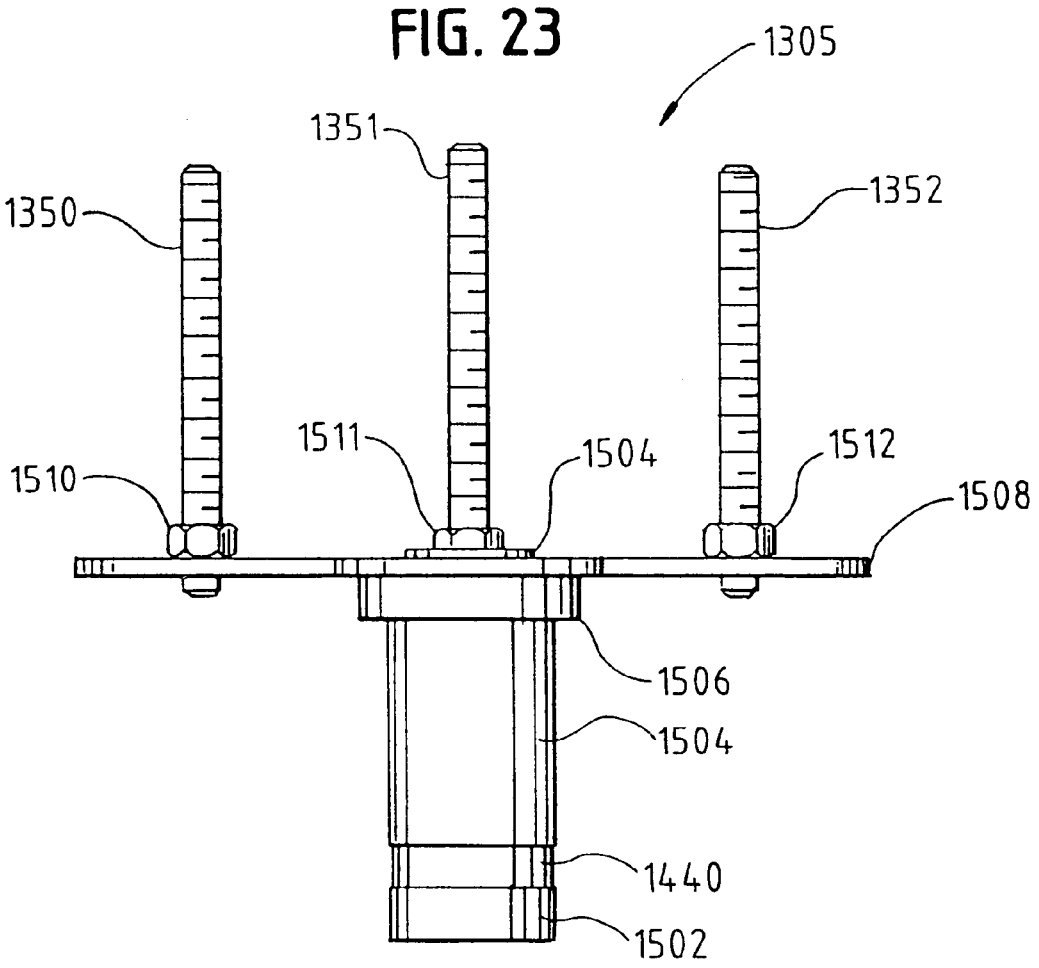
FIG. 23 is a side view of the moveable core assembly for the contactor of FIG. 21.

A side view of the moveable core assembly 1305 for the second alternative contactor 1300 is illustrated in FIG. 23. The moveable core assembly 1305 comprises a moveable core 1504 fixedly attached (preferably ring-staked) to the operator plate 1508 with a moveable core washer 1506 disposed therebetween. A permanent magnet 1440 is fixedly attached to the moveable core 1504 with a second core washer 1502 and a screw assembly (1660 in FIG. 24). This permanent magnet 1440 provides an increase in magnetic holding force to counteract the increased passive biasing force due to the third contact spring when the moveable assembly 1305 is in the first (i.e., upper) stable switching position. The three longitudinal shafts 1350, 1351 and 1352 are longitudinally attached (preferably threaded) to the operator plate 1508. Three hexnuts 1510, 1511 and 1512 are threaded on the longitudinal shafts 1350, 1351 and 1352, respectively, to rotationally, and thus longitudinally, stabilize the longitudinal shafts 1350, 1351 and 1352.

Figure 24:
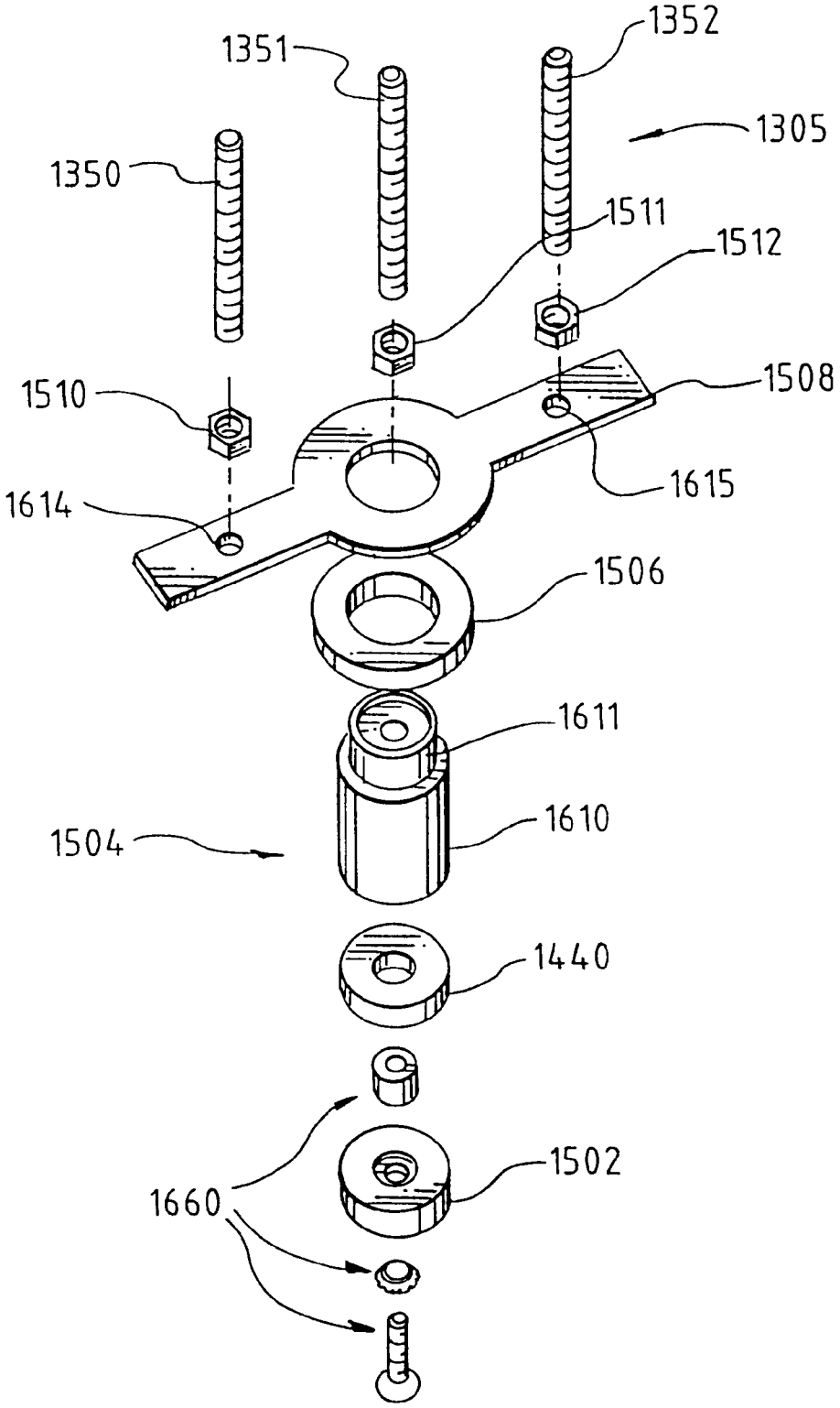
FIG. 24 is an assembly view of the assembly of FIG. 23.

An assembly diagram for the moveable core assembly 1305 for the second alternative contactor 1300 is shown in FIG. 24. The movable core 1504 has a wide section 1610 and a narrow section 1611. A moveable core washer 1506 is axially disposed about the narrow section 1611. The operator plate 1508 is similarly disposed about the narrow section 1611, which is then preferably ring-staked to the operator plate 1508. The permanent magnet 1440 is fixedly attached to the wide section 1610 of the movable core 1504 by a washer 1502 and screw assembly 1660. The operator plate 1508 comprises two tapped holes 1614 and 1615 to receive two of the threaded longitudinal shafts 1350 and 1352, which are axially threaded into the tapped holes 1614 and 1615 in the operator plate 1508 such that the desired longitudinal lengths of the longitudinal shafts 1350 and 1352 extend from the operator plate 1508. The third threaded longitudinal shaft 1351 is axially threaded through the center of the operator plate 1508 and into the top of the narrow portion 1611 of the movable core 1504, such that the desired longitudinal length of this third longitudinal shaft 1351 also extends from the operator plate 1508. The hexnuts 1510, 1511 and 1512 are threaded onto the threaded longitudinal shafts 1350, 1351 and 1352, respectively, and tightened to the operator plate 1508 to rotationally, and thus longitudinally, stabilize the longitudinal shafts 1350, 1351 and 1352.

The present invention provides an improved electrical contactor with multiple stable switching positions, which results in increased operational energy efficiency and reduced contactor heating. In addition, the electrical contactor is reliable, manufacturable, and extendible to a wide variety of switched electrical current ranges.

While particular elements, embodiments and applications of the present invention have been shown and described, it will be understood that the invention is not limited thereto since modifications may be made by those skilled in the art, particularly in light of the foregoing teachings. It is therefore contemplated by the appended claims to cover such modifications as incorporate those features, which come within the spirit and scope of the invention.

What is claimed is:

1. An improved magnetic latching contactor comprising:

a stationary assembly;

a moveable assembly that is slidably coupled with the stationary assembly; a contact assembly that is coupled with the stationary assembly and with the moveable assembly and that is movable selectively between a first stable switching position and a second stable switching position, where an electrical closed circuit is established when the contact assembly is in one of the first stable switching position and the second stable switching position, and where an electrical open circuit is established when the contact assembly is in the other of the first stable switching position and the second stable switching position;

a conductive coil assembly that is included in the stationary assembly, that has a longitudinal central axis, that has a first axial end and a second axial end, and that has electrical coil windings which are annularily disposed about and define a central inner axial cavity extending between the first axial end and the second axial end, which have a central axis coaxial with the longitudinal central axis of the conductive coil assembly, and which include winding terminals for supplying electric current to the electrical coil windings so that when an electrical current is supplied to the electrical coil windings, a magnetic field will selectively be established so as to selectively bias the movable assembly so as to enable the contact assembly to move to one of the first stable switching position and the second stable switching position and so that when another electric current is supplied to the electrical coil windings, a magnetic field will selectively be established so as to selectively bias the movable assembly so as to enable the contact assembly to move to the other of the first stable switching position and the second stable switching position;

a first permanent magnet that is disposed axially adjacent the central inner axial cavity so that the magnetic force field of the first permanent magnet is parallel with the central longitudinal axis of the conductive coil assembly;

the movable assembly including a movable core that is coupled with the contact assembly, that is disposed in the central inner axial cavity adjacent~ to an axial end of the conductive coil assembly, that is movable axially in the inner axial cavity between a first position in which the contact assembly is in the first stable switching position and in which the movable core is axially adjacent to the first permanent magnet and a second position in which the contact assembly is in the second stable switching position and in which the movable core is axially spaced from the first position; and a coil compression spring that is co-axially disposed with respect to the longitudinal central axis of the conductive coil assembly and that biases the movable core to the second position whereby when the movable core is in the first position, the biasing force applied to the movable core by the first permanent magnet is greater than the biasing force applied to the movable core by the coil compression spring so that the movable core will remain in the first position in the absence of an additional biasing force being applied to the movable core through an energization of the coil windings that would bias the movable core to the second position; and whereby when the movable core is in the second position, the biasing force applied to the movable core by the coil compression spring is greater than the biasing force applied to the movable core by the first permanent magnet so that the movable core will remain in the second position in the absence of an additional biasing force being applied to the movable core by an energization of the coil windings that would bias the movable core to the first position.

2. The improved magnetic latching contactor of claim 1 wherein the first permanent magnet is disposed within the central inner axial cavity defined by the electrical coil windings and between the first and second axial ends of the conductive coil assembly.

3. The improved magnetic contactor of claim 2 wherein the movable core had a first end that is axially adjacent the first permanent magnet; and wherein a second permanent magnet is carried by the first end of the moveable core.

4. The improved magnetic latching contactor of claim 3 wherein at least one metal member is disposed between the first and second magnets; and wherein the magnetic fields of the first and second magnets are mutually attractive.

5. The improved magnetic latching contactor of claim 3 wherein the first and second permanent magnets are disposed within the central inner axial cavity defined by the electrical coil windings and between the first and second axial ends of the conductive coil assembly.

6. The improved magnetic latching contactor of claim 3 wherein contact assembly includes move than one pair of contact plates and switch contact bridges.

7. The improved magnetic latching contactor of claim 6 wherein at least one metal member is disposed between the first and second magnets; wherein the magnetic fields of the first and second magnets are mutually attractive, and wherein the first and second permanent magnets are disposed within the central inner axial cavity by the electrical coil windings and between the first and second axial ends of the conductive coil assembly.

8. The improved magnetic latching contactor of claim 1 wherein the moveable core includes an axially extending, longitudinal shaft that has a distal end; and wherein the distal end is in contact with the contact assembly when the movable core moves from the final position to the second position and thereby causes the contact assembly to move from the first stable switching position to the second stable switching position.

9. The improved magnetic latching contactor of claim 1 wherein the electric current and the other electric current, which are supplied to the electrical coil windings, are in the opposite directions.

* * * * *